US007690641B2

(12) United States Patent
Jowett et al.

(10) Patent No.: US 7,690,641 B2
(45) Date of Patent: Apr. 6, 2010

(54) GATELESS DIVERTER—'S' SHAPED PAPER PATH

(75) Inventors: Simon Neil Jowett, London (GB); Richard Thomas Calhoun Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 136 days.

(21) Appl. No.: 11/809,950

(22) Filed: Jun. 4, 2007

(65) Prior Publication Data

US 2008/0296837 A1 Dec. 4, 2008

(51) Int. Cl.
*B65H 3/44* (2006.01)

(52) U.S. Cl. ..... 271/9.13; 271/9.01

(58) Field of Classification Search ..... 271/9.01, 271/264, 272, 225, 9.13; 399/406
See application file for complete search history.

(56) References Cited

U.S. PATENT DOCUMENTS

| | | | | |
|---|---|---|---|---|
| 4,990,967 | A | 2/1991 | Colglazier et al. | |
| 5,003,346 | A | 3/1991 | Masuda et al. | |
| 5,022,639 | A | 6/1991 | DuBois | |
| 5,067,305 | A | 11/1991 | Baker et al. | |
| 5,083,170 | A | 1/1992 | Sawada et al. | |
| 5,168,307 | A | 12/1992 | Masuda et al. | |
| 5,182,597 | A | 1/1993 | Masuda et al. | |
| 5,191,379 | A * | 3/1993 | Manzer et al. | 399/406 |
| 5,390,011 | A | 2/1995 | Theodoulou | |
| 5,396,322 | A | 3/1995 | Lawrence et al. | |
| 5,448,338 | A | 9/1995 | Masuda et al. | |
| 5,629,762 | A | 5/1997 | Mahoney et al. | |
| 6,064,853 | A | 5/2000 | Embry et al. | |
| 6,112,048 | A | 8/2000 | Westhoff | |
| 6,155,561 | A * | 12/2000 | Mandel | 271/254 |
| 6,273,414 | B1 * | 8/2001 | Matsuo | 271/9.11 |
| 6,293,541 | B1 * | 9/2001 | Horiuchi et al. | 271/184 |
| 6,385,431 | B1 | 5/2002 | Arcaro et al. | |
| 6,415,130 | B1 * | 7/2002 | Fujiwara et al. | 399/401 |
| 6,540,224 | B2 * | 4/2003 | Luther | 271/184 |
| 6,709,177 | B1 * | 3/2004 | Sugimura | 400/605 |

(Continued)

*Primary Examiner*—Patrick H Mackey
*Assistant Examiner*—Jeremy Severson
(74) *Attorney, Agent, or Firm*—Fay Sharpe LLP

(57) ABSTRACT

In accordance with one aspect of the present exemplary embodiment, a system transports paper to prevent stubbing within a printing machine. The paper path facilitates transport of one or more sheets of paper from the first end to the second end, each sheet of paper has a leading edge. A first entry point is located between the first end and the second end that allows one or more sheets to enter the paper path in succession. A first nip is adjacent to the first entry point to direct the leading edge of the one or more sheets away from the first entry point. A second entry point is located a distance from the first entry point that allows one or more sheets to enter the paper path. A second nip is adjacent to the second entry point to direct the leading edge of the one or more sheets away from the second entry point. A gateless diverter directs the one or more sheets of paper through the paper path which includes a convex section that is adjacent to a concave section to divert the leading edge of each of the one or more sheets away from the first entry point and the second entry point. The one or more sheets of paper are advanced to the convex section via the first nip in advance to the concave section to the second nip.

20 Claims, 5 Drawing Sheets

U.S. PATENT DOCUMENTS 6,782,237 B2 * 8/2004 Takai et al. ..... 399/406
7,133,640 B2 11/2006 Zeller et al.
7,237,772 B2 * 7/2007 Kamamura ..... 271/9.01
2003/0011126 A1 * 1/2003 Miyazawa ..... 271/264
2003/0214091 A1 * 11/2003 Suzuki et al. ..... 270/17
2004/0000752 A1 * 1/2004 Hsu et al. ..... 271/264
2007/0003344 A1 1/2007 Lee et al.

* cited by examiner

GATELESS DIVERTER—'S' SHAPED PAPER PATH

BACKGROUND

The present disclosure broadly relates to printing systems and, more particularly, to paper sheet transport within printing systems. A gateless diverter consists of adjoining concave and convex elements to direct the leading edge of paper in transport away from potential stubbing points in a paper path.

Known printing systems are generally capable of marking sheets of media of a variety of types (e.g., plain paper, bond paper, recycled paper, card stock, and transparencies), sizes (e.g., letter, legal, A3, A4) and/or in different orientations (e.g., long-edge feed, short-edge feed). Typically, a known printing system will include at least one media tray capable of receiving a bulk quantity (e.g., stack, package, ream) of sheets of media and introducing the bulk quantity to a suitable sheet feeding system or mechanism to advance individual sheets in an known manner. Often, known printing systems will include numerous media trays with each tray receiving a different type, size and/or orientation of sheet media.

Many known printing systems are capable of determining which particular one of a number of pre-defined sizes and/or orientations of sheet media have been loaded into the storage tray. Unfortunately, these and other known printing systems and media tray arrangements suffer from problems and disadvantages that can, in certain applications, limit the use and/or effectiveness of the same. Similarly, the transport of paper sheets within a printing system can pose difficulties due to stubbing and/or jamming within a paper path.

In one example, paper is transported within the printing system via a path located within a door. In particular, the door paper path transports one or more sheets vertically from a tray module to an image marking engine (IME). These sheets can be introduced from both a multi-sheet inserter (MSI) and a paper feed platform (PFP) and can act as an inverter for sheets entering from a duplex path of the IME. The proximity of the MSI and PFP entry chutes, coupled with the offset of nips within the paper path, provide potential stubbing points when feeding sheets from the tray module. Actuated diverters have traditionally been employed in conventional print system designs. Diverters, however, add cost to print system designs since extra components are required. Moreover, actuated diverters wear down mechanically and are unreliable for long term use which is required of most printing systems. What are needed are systems and methods that overcome the above referenced difficulties associated with paper transport within a print system.

BRIEF DESCRIPTION

In one aspect, a system transports paper to prevent stubbing within a printing machine. The paper path has a first end and a second end and a width defined by a first wall located in opposition to a second wall. The paper path facilitates transport of one or more sheets of paper from the first end to the second end, each sheet of paper has a leading edge. A first entry point is located between the first end and the second end that allows one or more sheets to enter the paper path in succession. A first nip is adjacent to the first entry point to direct the leading edge of the one or more sheets away from the first entry point. A second entry point is located a distance from the first entry point that allows one or more sheets to enter the paper path. A second nip is adjacent to the second entry point to direct the leading edge of the one or more sheets away from the second entry point. A gateless diverter directs the one or more sheets of paper through the paper path. The gateless diverter includes a convex section that is adjacent to a concave section to divert the leading edge of each of the one or more sheets away from the first entry point and the second entry point. The one or more sheets of paper are advanced to the convex section via the first nip in advance to the concave section to the second nip.

In another aspect, a system is employed to transport paper within a printing machine. A paper path that has a first end and a second end and a width defined by a first wall located in opposition to a second wall facilitates transport of paper from the first end to the second end. A first entry point is located at an angle to the paper path that allows one or more sheets of paper to enter the paper path in succession. A convex section is adjacent to the first entry point that directs the leading edge of the one or more sheets away from the first entry point. A second entry point is located a distance from the first entry point that allows paper to enter the paper path. A concave section is located between the convex section and the second entry point to direct the leading edge of the one or more sheets of paper away from the second entry point. A ramp is located adjacent to each of the first entry point and the second entry point, wherein the ramp is a recessed portion of the side wall of the paper path that is shared with each of the first entry point and the second entry point.

In yet another aspect, a method is employed to transport paper to avoid stubbing within a printing machine. A sheet of paper is received into a first end of a paper path, the sheet of paper has a leading edge. The sheet of paper is advanced through the paper path via a first nip to a second nip, wherein the first nip and the second nip each include at least one pair of rollers. The leading edge of the sheet is directed away from the first entry point via the second nip, the first entry point is located on the side of the paper path. The sheet of paper is advanced to the first entry point through a convex section in a concave section of the paper path, wherein the convex section is located adjacent to the concave section. The leading edge of the sheet is directed away from the second entry point via a third nip, the second entry point is located on the side of the paper path.

DETAILED DESCRIPTION

The embodiments described herein relate to an 'S' shaped gateless diverter for transport of paper sheets within a printing machine. A novel curved section of a paper path starts just prior to a first entry point (e.g., for a paper feed platform chute) and ends at just after a second entry point (e.g., for a multiple sheet inserter chute). The radii of the concave/convex sections and transition points are designed to ensure that curled sheets being fed from a multiple tray module avoid stubbing on exit chutes of one or more ancillary feeders. This ensures that the leading edge of a sheet is directed towards the right hand paper path away from the chutes. Both the proximity of the first and second entry points, coupled with the fact that they are offset, ensures that potential stubbing issues are produced if a straight paper path is employed. This avoids the requirement for actuated diverter gates.

Figure 1:
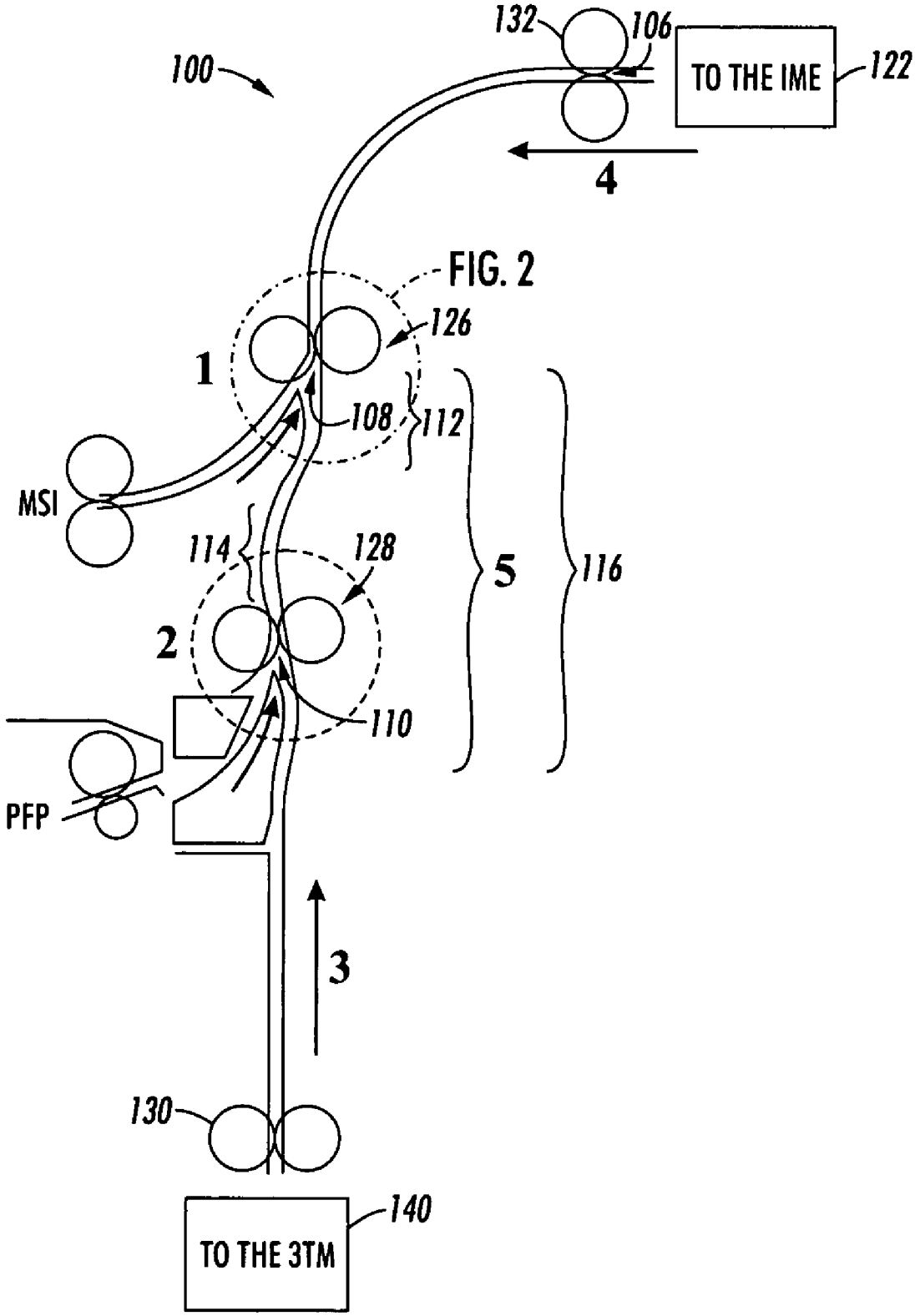
FIG. 1 illustrates a paper path, in accordance with an aspect of the subject embodiment.

With reference to FIG. 1, a paper path 100 is illustrated that allows sheets of paper to be fed from a number of trays in a print system without stubbing. In one example, the paper path 100 can transport paper sheets from an entry point (e.g., a multi-tray module) 104 to an entry/exit point (e.g., an image marking engine) 106. Entry points 108 and 110 allow paper sheets to be fed into the paper path 100 at additional locations to accommodate various desired operations. As illustrated, the entry points 108 and 110 inherently include one or more potential stubbing points (e.g., tips) based on an angle of entry into the paper path 100. Pages can also be stubbed if a paper path includes excessively acute angles and/or radii that are overly restrictive relative to the size of sheets that are fed through a paper path.

In conventional printing machines, there are a number of potential stubbing points associated with a paper path. First, all sheets fed from a multiple (e.g., three) tray module are transported vertically upwards through a section of a paper path towards the IME. As the sheet passes the entry points 108 and 110, it must avoid stubbing on the entry chutes associated therewith. Stubbing is potentially a problem for three different types of curl: down curled sheets in the process direction, cross process curled sheets, or bowl curled sheets (a combination of both process and cross process curl).

Secondly, sheets fed from entry points 108 and 110 must avoid stubbing on the right side of the paper path as illustrated in FIG. 1. The worst case for this problem is down-curled media stubbing on the right hand guide. Third, sheets fed from entry point 106 (e.g., a duplex path) must avoid stubbing with both the entry points 108 and 110 as the sheet is transported from the top (e.g., IME) of the paper path 100. The leading edge of sheets from the entry point 106 in the duplex path must pass both the entry points 108 and 110 in order to enable larger (e.g., A3) sheets to be inverted. In particular, out-curled sheets pose a significant problem in terms of stubbing. It is to be appreciated that although paper sheets are discussed herein, substantially any material can be employed for sheets including acetate, velum, etc.

In order to insure stub free travel in either direction along the paper path 100, a concave section 112 and a convex section 114 are positioned adjacent to each other to create an 'S' shaped gateless diverter 116. As a sheet passes entry points 108 and 110, the concave portion 112 and convex section 114 direct the leading edge of a sheet (not shown) away from potential stubbing points. In one aspect, the gateless diverter 116 reduces cross-process and bowl curl of pages that conventionally causes paper to stub on one or more obstacles within a paper path.

It is to be appreciated that substantially any number of concave sections and corresponding adjacent convex sections can be employed to eliminate stubbing within the paper path 100. Moreover, the radii and angle of direction of transport can vary to accommodate one or more metrics associated with printing such as paper size, paper thickness, print application, etc. The location of such adjacent concave and convex sections can be related to particular features of the paper path 100 such as one or more stubbing points, entry chutes, and path distance for example.

In an exemplary operation, a sheet enters the paper path 100 from one of four entry points 104, 106, 108, and 110. Sheets that enter the paper path 100 via 108 are illustrated as path 1; sheets that enter the paper path 100 via 110 are illustrated as path 2; sheets that enter the paper path 100 via 104 are illustrated as path 3; and sheets that enter the paper path 100 via 106 are illustrated as path 4. In addition, four nips, 126, 128, 130, and 132 are located throughout the paper path 100 to facilitate transport of paper sheets as they pass therethrough. In one example, each nip includes a pair of rollers (or equivalent) that rotate in an appropriate direction when in contact with a paper sheet.

In one example, the entry point 108 receives one or more sheets from a multiple sheet inserter (MSI). The one or more sheets are transported through a left hand door of a printing system to an image marking engine (IME) 122 via exit/entry point 106. In another example, one or more sheets are received by the paper path 100 via entry point 110 from a paper feed platform (PFP) that docks to the side of the printing machine. The one or more sheets are transported vertically through a door to the IME.

Alternatively or in addition, one or more sheets are fed to the paper path 100 via entry point 104 from a three tray module (3TM). The one or more sheets travel vertically through a door past the entry points 108 and 110 to the IME 122 via entry/exit point 106. Once the sheets are processed by the IME 122, they can re-enter the paper path 100 (via a duplex path) again through entry point 106. In one example, the one or more sheets are longer than a standard (e.g., 8½"–11", A4) size. Such an excessive length can cause sheets to become stubbed on one or more obstacles within the paper path 100.

For instance, for an A3 or 11"×17" sheet, the lead edge can travel down the paper path past entry point 108. In conventional systems, as a sheet passes an entry point on a paper path, the leading edge can become stubbed. This is especially true as the sheet passes between entry points (e.g., between entry points 108 and 110). In order to mitigate such stubbing, the concave section 112 and the convex section 114 are adjacently placed between the entry points to divert the leading edge of one or more sheets away from the entry points 108 and 110 as they pass. The nips 126 and 128 can be placed adjacent to the entry points 108 and 110 respectively to facilitate transport of one or more sheets through the paper path 100 and/or to prevent stubbing.

Figure 2:
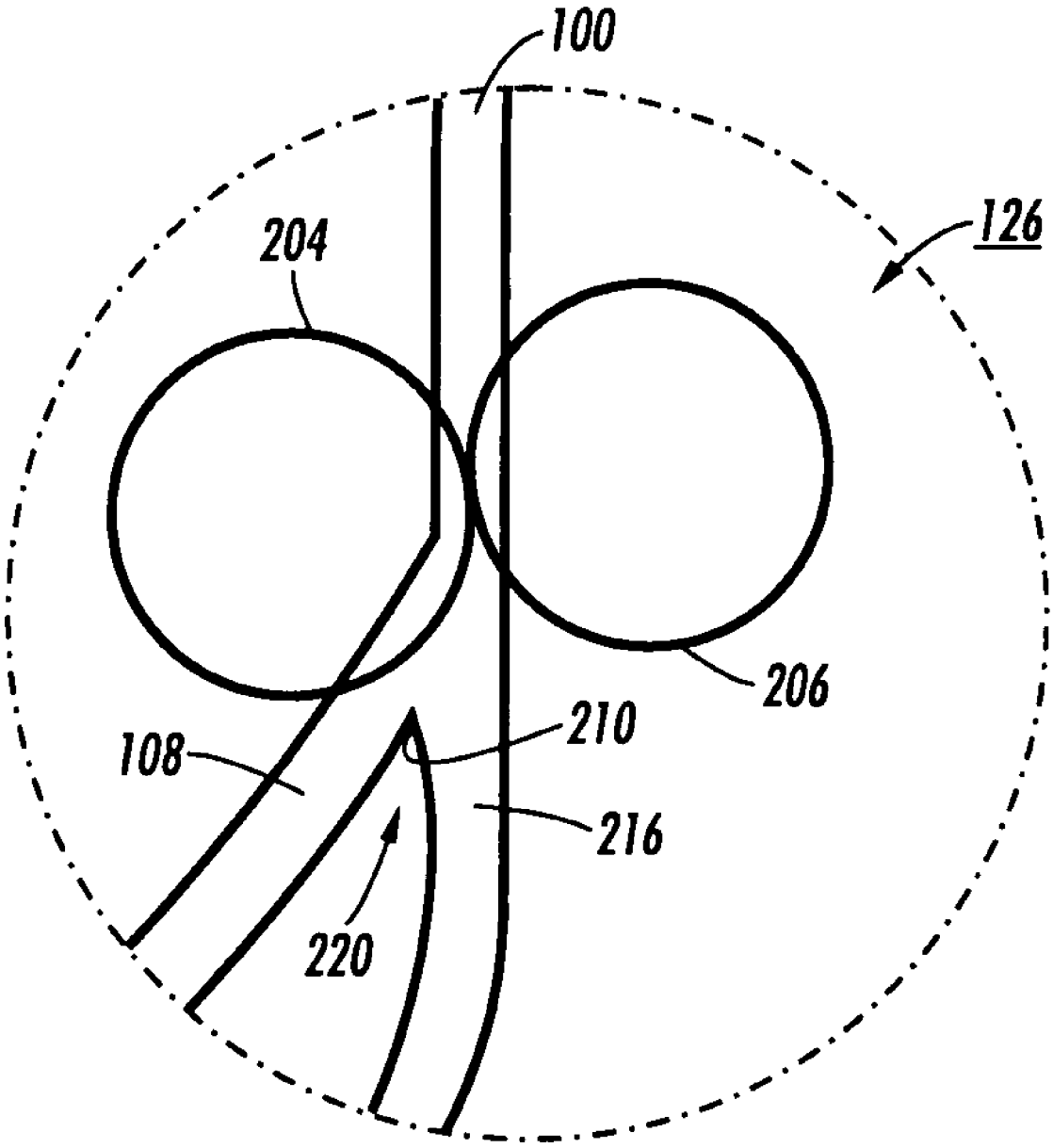
FIG. 2 illustrates a nip adjacent to an entry point, in accordance with an aspect of the subject embodiment.

FIG. 2 illustrates the nip 126 that is utilized adjacent to entry point 108 as shown in FIG. 1 above. The nip 126 includes a roll 204 and a roll 206. Although a single roll pair 204 and 206 is illustrated, it is to be appreciated that a plurality of nips and associated roll pairs can be located across the width of the paper path 100. The rolls 204 and 206 can be comprised of substantially any material such as rubber, plastic, steel, etc. to facilitate optimum contact with the paper sheets that are passed therethrough.

In one example, a sheet is transported past the entry point 108 via the nip 126 and past the entry point 110 via the nip 128. Because the entry points 108 and 110 are located on the left hand side of the paper path 100, the nips 126 and 128 are rotated as the paper sheets enter to divert the sheet to the right hand side of the paper path. In this manner, the leading edge of the papersheet is moved as far from possible from the entry points to minimize the possibility of the sheet stubbing and/or directed down an undesired path.

To direct the sheet in a desired direction, the rolls 204 and 206 can be positioned in particular location relative to each other or one or more features of the paper path 100. For example, the roll 204 can be placed such that the diameter of the roll 204 is lower relative to the diameter of the roll 206. In addition, the center line of the rolls (e.g., location wherein the rolls 204 and 206 are in the closest proximity to one another), can be offset from the center line of the paper path. For instance, center line of the rolls 204 and 206 can be located offset to the right relative to the center line of the paper path. In this manner, the leading edge of the sheet can be directed to the right based on the relative force of the rolls 204 and 206 on the sheet as it passes through the nip 126.

The tip 210 is the point of divergence between the paper path 100 and the entry point 108. In one embodiment, the tip 210 is recessed from the paper path 100 to avoid sheet (e.g., duplex) stubbing or travelling down the incorrect path. Such tip 210 location provides a greater clearance for the leading edge of a sheet to pass the entry point 210 unencumbered. To further enhance control of the leading edge location within the paper path, a ramp 216 is situated just past the entry point 108 within the paper path 100. The ramp 216 is a recessed portion of the side wall of the paper path that is shared with the entry point 108. The ramp 216 can have substantially any radius relative to a center point 220. This radius can be based at least in part upon the paper size, paper thickness and printing operation performed within the printing machine.

Figure 3:
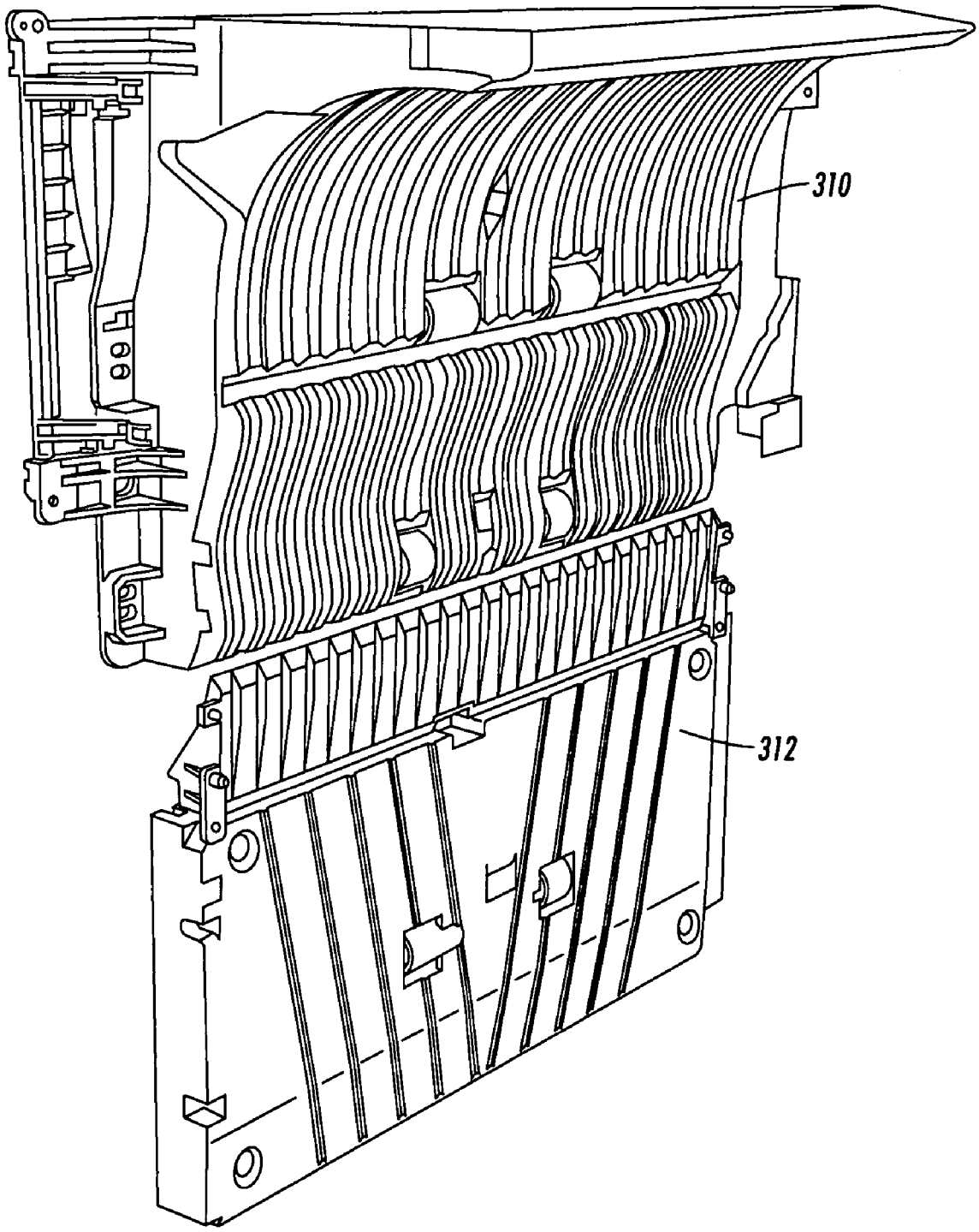
FIG. 3 illustrates a paper path employed with an upper and mid door of a printing machine, in accordance with an aspect of the subject embodiment.
Figure 4:
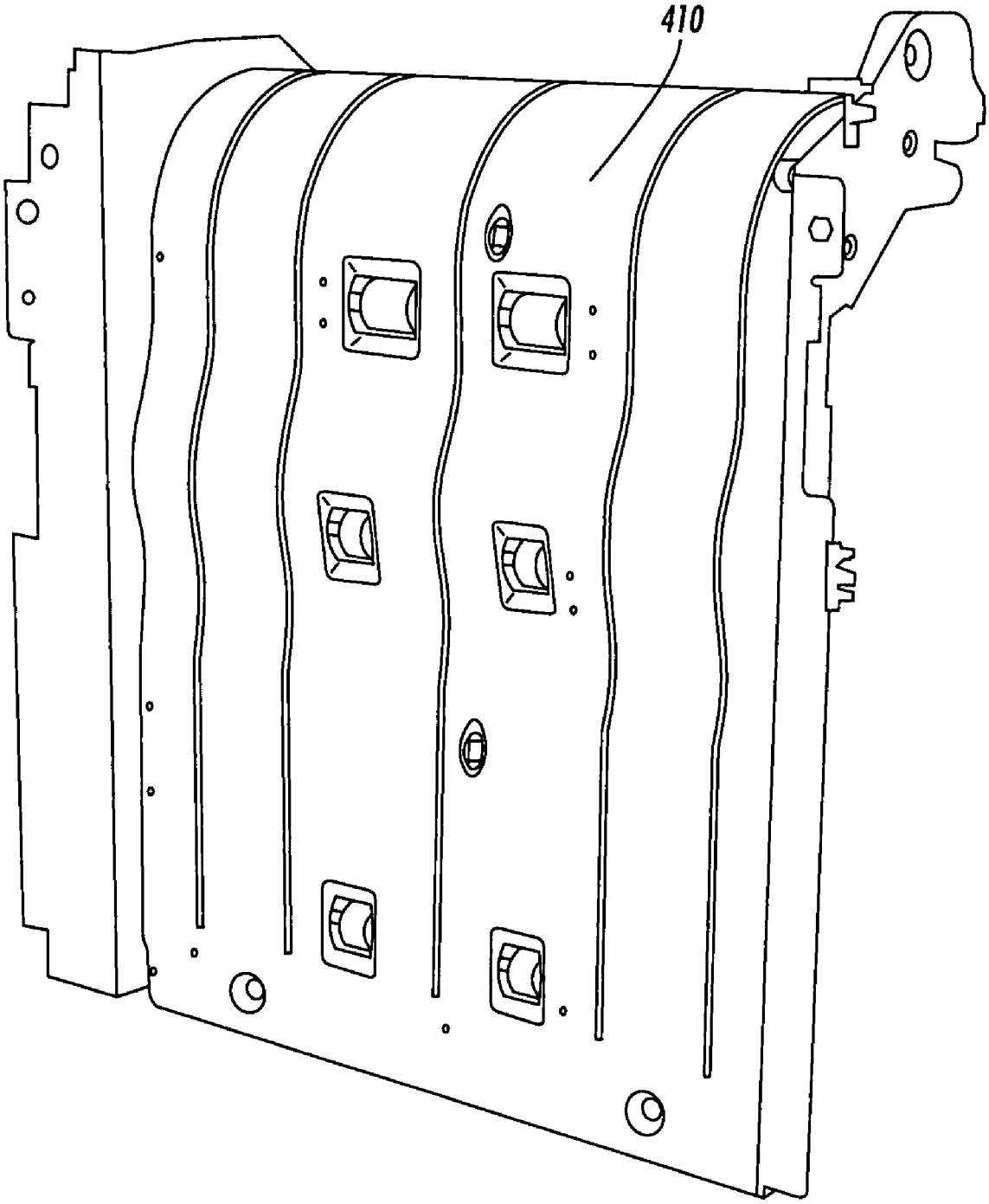
FIG. 4 illustrates a paper path utilized with a vertical paper path baffle, in accordance with an aspect of the subject embodiment.

In many printing machines, actuated diverters are employed to ensure that paper sheets travel along an intended path (e.g., the paper path 100). The paper path 100 must be robust to all potential stubbing points by taking into account up-curl, down-curl and cross process curl of the paper sheets. FIG. 3 illustrates an upper door 310 and a mid door 312 of a printing machine that utilize the paper path 100 to transport paper sheets therethrough. Similarly, FIG. 4 illustrates a paper path baffle 410 employed with a printing machine that includes the paper path 100. It is to be appreciated that the gateless diverter 116 can be employed in substantially any location within substantially any printing machine.

In one example, the upper door 310, the mid door 312, and the paper path baffle 410 can be center registered wherein all the nip pairs through each component are double rolls located in the center of the paper path. As a result, the extreme edges of the sheet are not controlled by the roller pairs which creates a number of potential stubbing points caused by cross process curl. Conventionally, gateless diverters have been employed in printing machines to overcome such deficiencies. However, a gateless diverter has not been contemplated with these components in the areas of a printing machine illustrated in FIGS. 3 and 4. One reason is due to the proximity of entry points 108 and 110 (e.g., MSI and PFP chutes) and the fact that they are slightly offset.

Figure 5:
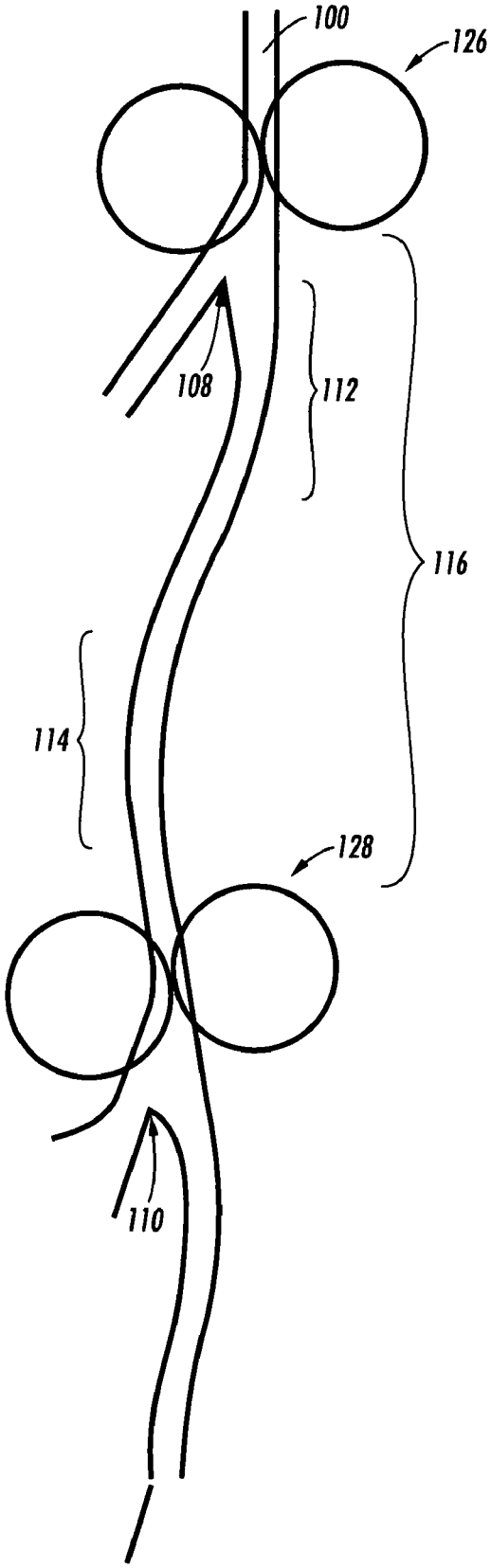
FIG. 5 illustrates a dimensioned view of the paper path, in accordance with an aspect of the subject embodiment.

FIG. 5 illustrates a dimensioned view of the paper path 100. It is to be appreciated that the dimensions are for illustrative purposes only and one or more dimensions can be modified within the scope of the embodiments described herein. A three-dimensional model was employed to verify a design for cross process and bowl curl. In particular, a path taken by extremities of sheets that are not controlled by the central nips. In one approach, sheets are fed with these three different types of curl to a stress level of 100 mm radius of curvature (e.g., 12 mm flat curl for a 60 gsm sheet). All stubbing points were eliminated.

Further analyses ensured that two other potential issues with the design were eliminated. First, the severity of the radii of the concave/convex sections (e.g., convex section 112 and 114) were minimized to ensure Nip G in the simplex direction and Nip E in the duplex direction have sufficient drive to feed heavyweight sheets through the paper path 100. Software was employed to predict the slip between the Nip G and Nip E. The slip levels that were predicted were not significant.

The contact forces between the sheet and guides were also predicted and checked against the image-marking limit for solid ink. The speed of the rolls of Nip E and Nip F were set to their worst case levels to either create a buckle between the nips or to stretch the sheet across the guides. The contact forces were checked against recommended guidelines for solid ink to PC-ABS, ABS and Steel to ensure that the image on the duplexed sheets was not damaged. The forces were well within the limits for all three materials.

It will be appreciated that variations of the above-disclosed and other features and functions, or alternatives thereof, may be desirably combined into many other different systems or applications. Various and variant embodiments presently unforeseen or unanticipated alternatives, modifications, variations or improvements therein may be subsequently made by those skilled in the art which are also intended to be encompassed by the following claims. In addition, the claims can encompass embodiments in hardware, software, or a combination thereof.

The invention claimed is:

1. A system for transporting paper to prevent stubbing within a printing machine, comprising:

a paper path that has a first end and a second end and a width defined by a first wall located in opposition to a second wall that facilitates transport of one or more sheets of paper from the first end to the second end, each sheet of paper has a leading edge;

a first entry point located between the first end and the second end that allows one or more sheets to enter the paper path in succession;

a first nip that is adjacent to the first entry point that directs the leading edge of the one or more sheets away from the first entry point;

a second entry point located a distance from the first entry point that allows one or more sheets to enter the paper path;

a second nip that is adjacent to the second entry point that directs the leading edge of the one or more sheets away from the second entry point; and an "S" shaped gateless diverter that directs the one or more sheets of paper through the paper path, the gateless diverter includes a convex section that is adjacent to a concave section to divert the leading edge of each of the one or more sheets away from the first entry point and the second entry point, wherein the one or more sheets of paper are advanced to the convex section via the first nip and advanced through the concave section to the second nip.

2. The system according to claim 1, wherein the entry point includes a chute that allows paper to enter the paper path.

3. The system according to claim 1, wherein the gateless diverter compensates for one or more of a bowl curl, a cross-process curl, an up curl, and a down curl of the one or more sheets.

4. The system according to claim 1, wherein the sheets are one or more of a paper, an acetate, and a velum.

5. The system according to claim 1, wherein the first nip and the second nip each include at least one roller pair that consists of a first roller and a second roller.

6. The system according to claim 5, wherein the center of the nip is located off the center line of the paper path to direct paper in a particular direction.

7. The system according to claim 1, wherein the gateless diverter includes a plurality of concave sections and convex section, each concave section is adjacent to a convex section and each convex section is adjacent to a concave section.

8. The system according to claim 1, wherein the location of gateless diverter is dependent on the location of one or more stubbing points within the paper path.

9. The system according to claim 1, wherein the size of the gateless diverter is dependent on at least one of a sheet size, a sheet thickness, and a print application.

10. The system according to claim 1, wherein the first entry point and the second entry point each include a ramp that is a recessed portion of the side wall of the paper path that is shared with the entry point.

11. The system according to claim 1, wherein the paper path is located within one of an upper door, a mid-door, a lower door and a baffle within the printing machine.

12. A system that transports paper within a printing machine, comprising:

a paper path that has a first end and a second end and a width defined by a first wall located in opposition to a second wall to facilitate transport of paper from the first end to the second end;

a first entry point that is located at an angle to the paper path that allows one or more sheets of paper to enter the paper path in succession;

a convex section that is adjacent to the first entry point that directs the leading edge of the one or more sheets away from the first entry point;

a second entry point that is located a distance from the first entry point that allows paper to enter the paper path;

a concave section that is located between the convex section and the second entry point to direct the leading edge of the one or more sheets of paper away from the second entry point; and a ramp that is located adjacent to each of the first entry point and the second entry point, wherein the ramp is a recessed portion of the side wall of the paper path that is shared with each of the first entry point and the second entry point, wherein said convex and concave sections are adjacent to one another and create an 'S' shaped portion in said system.

13. The system according to claim 12, wherein a nip is located adjacent to each of the first entry point and the second entry point.

14. The system according to claim 13, wherein the nip includes at least one roller pair, and includes a first roller and a second roller.

15. The system according to claim 13, wherein the center of the nip is located off the center line of the paper path to direct paper in a particular direction.

16. The system according to claim 13, wherein the diameter of the first roller is lower relative to the diameter of the second roller.

17. The system according to claim 12, wherein the first entry point feeds paper from a multiple sheet inserter.

18. The system according to claim 12, wherein the second entry point feeds paper from a paper feed platform.

19. The system according to claim 12, wherein the first entry point and the second entry point each include a ramp which is a recessed portion of the side wall of the paper path that is shared with the entry point.

20. A method for transporting paper to avoid stubbing within a printing machine, comprising:

receiving a sheet of paper into a first end of a paper path, the sheet of paper has a leading edge;

advancing the sheet through the paper path via a first nip to a second nip, wherein the first nip and the second nip each include at least one pair of rollers;

directing the leading edge of the sheet away from a first entry point via the second nip, the first entry point is located on the side of the paper path;

advancing the sheet past the first entry point through an 'S' shaped portion including a convex section and a concave section of the paper path, wherein the convex section is located adjacent to the concave section; and directing the leading edge of the sheet away from a second entry point via a third nip, the second entry point is located on the side of the paper path.

* * * * *